United States Patent [19]

Taplin

[11] 4,303,287

[45] Dec. 1, 1981

[54] LOCKING MECHANISM FOR A STORAGE CABINET

[75] Inventor: John F. Taplin, Surrey, England

[73] Assignee: Vickers Limited, London, England

[21] Appl. No.: 118,318

[22] Filed: Feb. 4, 1980

[51] Int. Cl.[3] ..... E05B 65/46; E05C 7/06

[52] U.S. Cl. ..... 312/215; 312/217; 312/220; 312/221; 312/107.5; 292/DIG. 49

[58] Field of Search ..... 312/220, 215, 216, 217, 312/218, 219, 221, 107.5; 292/DIG. 49

[56] References Cited

U.S. PATENT DOCUMENTS

| | | | |
|---|---|---|---|
| 335,668 | 2/1886 | Woodruff | 312/220 |
| 1,709,459 | 4/1929 | Callahan | 292/DIG. 49 |
| 2,486,460 | 11/1949 | Bonenberger | 312/215 |
| 2,814,543 | 11/1957 | Siegel | 312/218 |
| 2,873,159 | 2/1959 | Becker | 312/223 |
| 2,886,392 | 5/1959 | Stegmaier | 312/217 |
| 3,404,929 | 10/1968 | Wright et al. | 312/216 |
| 3,700,301 | 10/1972 | Boeck | 312/215 |
| 3,888,558 | 6/1975 | Himsl | 312/221 |
| 3,900,236 | 8/1975 | Goulish et al. | 312/217 |

*Primary Examiner*—Victor N. Sakran

*Attorney, Agent, or Firm*—Shoemaker and Mattare, Ltd.

[57] ABSTRACT

Initial opening movement of a drawer in a cabinet by cam action raises a locking bar to lock the other drawers closed. In so doing the locking bar rotates a pinion having an arm which stresses a spring carrying it past an over-center position to maintain the bar in locking position while the moving drawer travels to the fully open position. The end of the closure of this drawer by cam action returns the bar, arm and spring to their initial state. A key-lock mechanism can raise the bar to lock all the drawers shut. If the cabinet is tilted forward substantially, gravity causes a ball to run to a position to hold the pinion against rotation thereby preventing all the drawers from automatically becoming locked due to the bar running to the locking position under gravity or inertia.

8 Claims, 12 Drawing Figures

LOCKING MECHANISM FOR A STORAGE CABINET

FIELD OF THE INVENTION

This invention relates to a storage cabinet having a plurality of drawers arranged one above the other, and more particularly to an autolock mechanism in such a cabinet, for locking the remaining drawer(s) shut when one of them is opened.

DESCRIPTION OF THE PRIOR ART

Storage cabinets are known, including drawers arranged one above the other, in which the drawers can be opened and closed independently of one another. A disadvantage is that more than one drawer can be opened at once and if the drawers are sufficiently laden, this can result in the cabinet toppling over about the front edge of its base. This presents a serious hazard to users of such storage cabinets.

SUMMARY OF THE INVENTION

According to the invention, there is provided, in a storage cabinet having a plurality of drawers arranged one above the other, an autolock mechanism for locking the remaining drawer(s) shut when one of them is opened, the mechanism comprising an upright locking bar which is displaceable longitudinally of itself between upper and lower positions, one of which is a drawer-locking position and the other a drawer-releasing position, means associated with the drawers and operative to bring about locking bar displacement to lock the remaining drawer(s) shut during the initial part of opening one of the drawers, and retaining mechanism, including a spring, operable by the locking bar and arranged so that when the locking bar is moved from the drawer-releasing position to the drawer-locking position the spring passes through an over-centre position from a first state in which it tends to hold the locking bar in the drawer-releasing position to a second state in which it retains the locking bar in the drawer-locking position, the retaining mechanism being arranged so that the spring returns to the first state when the locking bar is returned to the drawer-releasing position. Preferably the spring is connected to a point in the retaining mechanism that undergoes augmented movement relatively to the movement of the locking bar.

In a preferred construction the retaining mechanism comprises a pinion whose teeth are engaged with complementary teeth on the locking bar and which bears an arm to which the spring is connected.

Conveniently, the upper and lower positions are respectively the drawer-locking and drawer-releasing positions.

In one preferred embodiment of the invention, the storage cabinet additionally includes a key-lock mechanism which is operatively coupled to the locking bar and which is so constructed and arranged as to permit the bar to be raised and lowered when the key-lock mechanism is unlocked but to raise the bar to lock all the drawers shut when the key-lock mechanism is locked.

It has been found that when the drawers have not been locked shut by the key-lock mechansim and when, for example, the cabinet is being carried up or down stairs in a position in which it is turned from the upright position to a position in which the locking bar can slide under its own weight or inertia towards its locking position, all the drawers will be locked shut by this movement. Then when the cabinet is returned to the upright position, the drawers will remain locked and cannot be unlocked by the lock because this will be held in the unlocked position by the locking bar in its raised position. It is therefore, a further object of the present invention to provide simple means whereby this action can be avoided.

Advantageously, therefore, a gravity responsive device operative on the retaining mechanism may be provided to inhibit longitudinal movement of the locking bar if the cabinet is tilted in such a way as to cause the locking bar to travel to its drawer locking position, the gravity responsive device thereby preventing all the drawers from becoming locked by such movement of the locking bar. The gravity responsive device may conveniently comprise a ball arranged to run along a track to a position in which it obstructs the operation of toothed gearing which would otherwise transmit the movement of the locking bar to the spring, this obstruction occurring when the locking bar is moved towards the horizontal position.

DESCRIPTION OF THE PREFERRED EMBODIMENTS

Figure 5:
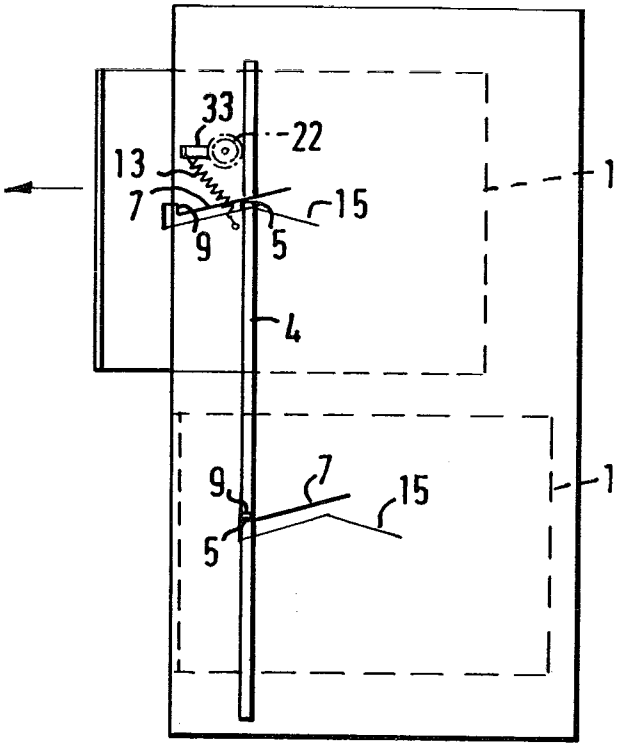
FIGS. 4 and 5 illustrate diagrammatically the operation of the drawer autolock mechanism.
Figure 4:
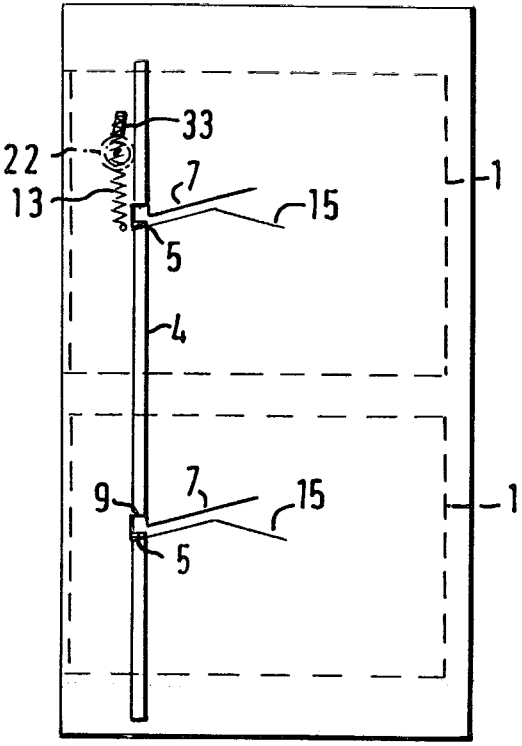
Figure 9:
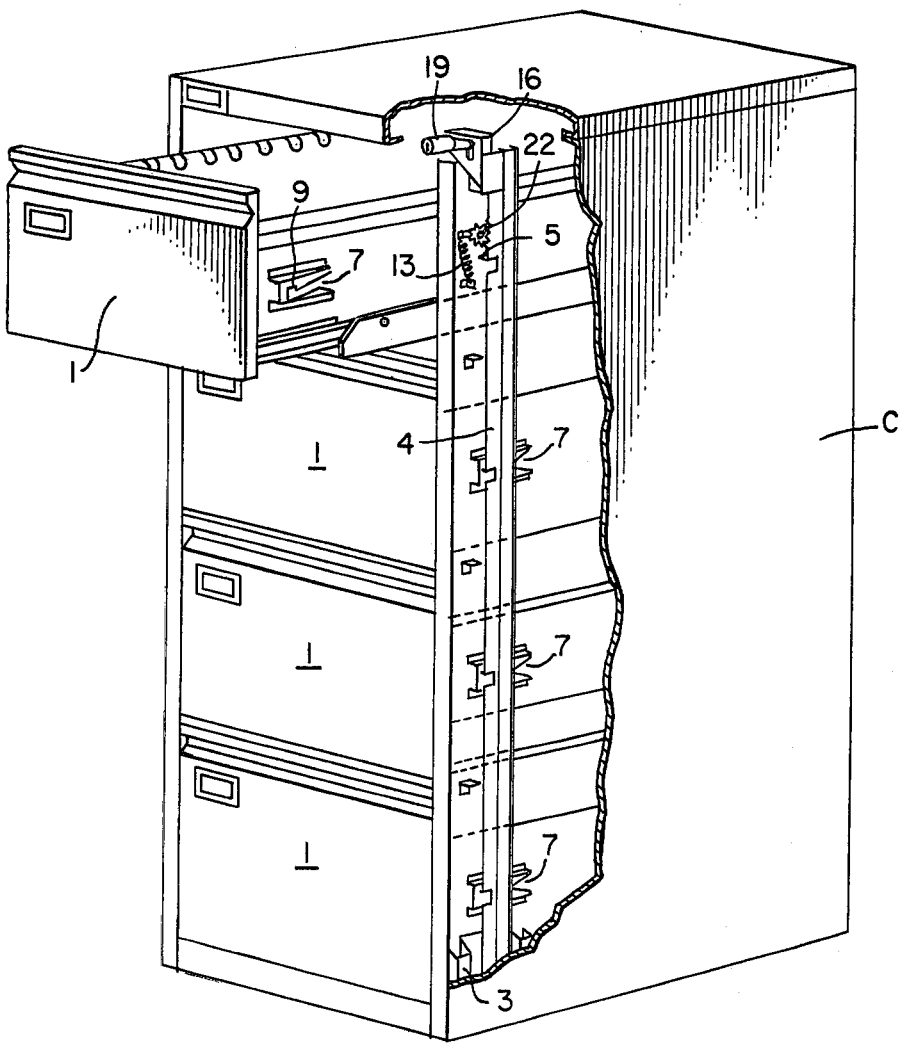
FIG. 9 is an isometric view of a four-drawer cabinet embodying autolock mechanism as described with reference to FIGS. 1 and 8 and shown with part of its wall broken away to disclose the mechanism.

Referring to FIGS. 1, 1B and 3 to 5, filing cabinet shown in FIG. 9 and only diagrammatically in FIGS. 4 and 5 comprises a number of drawers 1 arranged one above the other, the top drawer being shown open in FIGS. 5 and 9. It is to be understood that the following description of the top drawer and its associated components of the autolock mechanism applies equally to all the drawers 1.

Arranged just inside the drawer opening in the front of the filing cabinet, on one side (e.g., the right-hand side) of the opening, is an upright channel member 2 which has outwardly directed side wing portions providing feet 3 on opposite sides of the channel by which the channel member is secured to the inside surface of the side wall of the filing cabinet that is the portion of the side wall shown broken away in FIG. 9. Only the lower portion of the channel member 2 is shown in FIG. 9.

Arranged within the channel of the channel member along one of its sides so as to lie between the base wall of the channel member and the facing wall of the filing cabinet is a locking bar 4 which is U-shaped in cross-section and can slide vertically within the channel member the locking bar 4 being shown in longitudinal section in FIG. 9. One of the side walls of the locking bar is cut at locations spaced along its length to provide actuating tags 5 for the drawers, respectively. As can be seen in FIG. 1, the tag 5 for the top drawer is bent outwardly at right angles to the locking bar 4 to project through an aperture in the base wall of the channel member 2.

Each actuating tag 5 cooperates with an associated cam track 7, secured to the side wall of the associated drawer 1, in certain positions of the drawer as will be explained hereinbelow, and for this purpose, the upper and lower faces of the tag are inclined downwardly at a small angle, typically 15 degrees, to the horizontal for good bearing contact with the cam track 7. Conveniently, the cam track can be formed from a sheet metal blank which is bent to provide the required shape and then welded, for example, to the drawer side.

Figure 2:
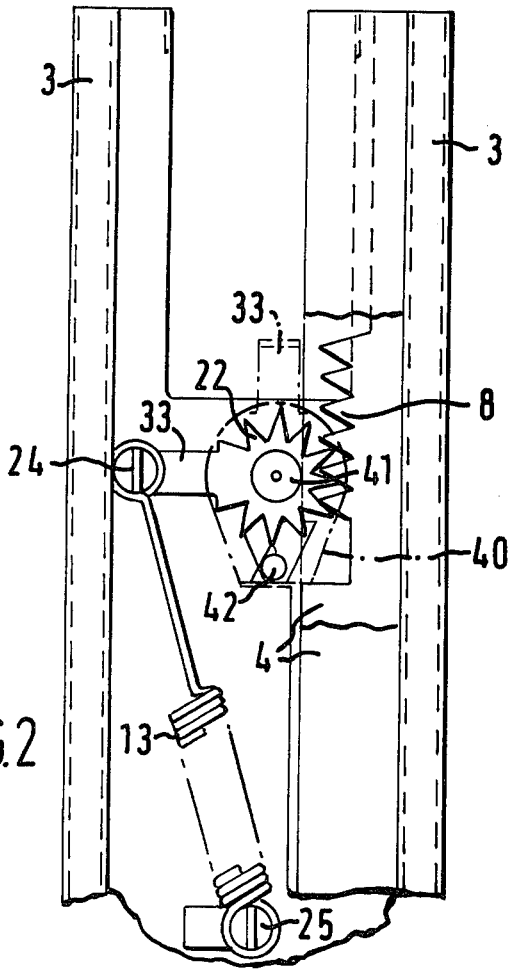

The locking bar 4 is formed along one edge with teeth 8 (FIG. 2) engaged with the teeth of a pinion 22 which is rotatably mounted on the channel member 2 and which bears a radially projecting arm 33. Conveniently, the pinion and arm can be formed by a single sheet steel pressing. The free end of the arm 33 is bent over to form a tag 24 around which is fitted one end of a tension spring 13 whose other end is fitted around a tag 25 which is stamped from the base wall of the channel member and then bent out of the plane of the base wall.

When all the drawers of the filing cabinet are shut but not locked by a key-lock mechanism to be described hereinbelow, the bar 4 is in its lower position and the spring 13 is in the position illustrated in FIG. 4. As the bar 4 is raised by the cam track 7 on opening one of the drawers, the bar rotates the pinion 22 anit-clockwise, and thereby causes the arm 33 to move from the broken line position of FIG. 2 so that the spring 13 goes beyond its over-centre position. As the drawer is opened further, the locking bar 4 arrives at its uppermost position, in which the spring 13 adopts the position shown in FIGS. 2 and 5. Then the spring, still under tension, exerts by way of a substantial turning moment on the arm 33 a sufficient upward force on the locking bar to retain it in that position as the drawer is opened further.

Figure 1A:
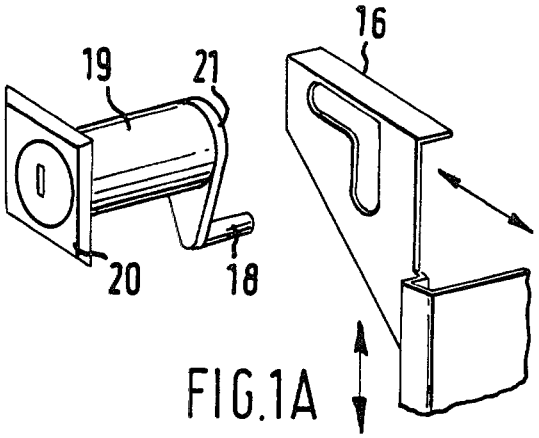
FIG. 1A is an exploded perspective view showing details of a drawer key-lock device.
Figure 1C:
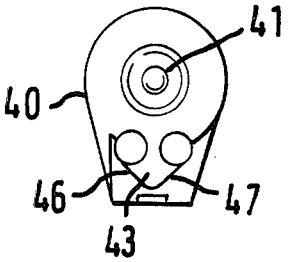
FIG. 1C is an elevation of a detail of the mechanism shown in FIG. 1.
Figure 1:
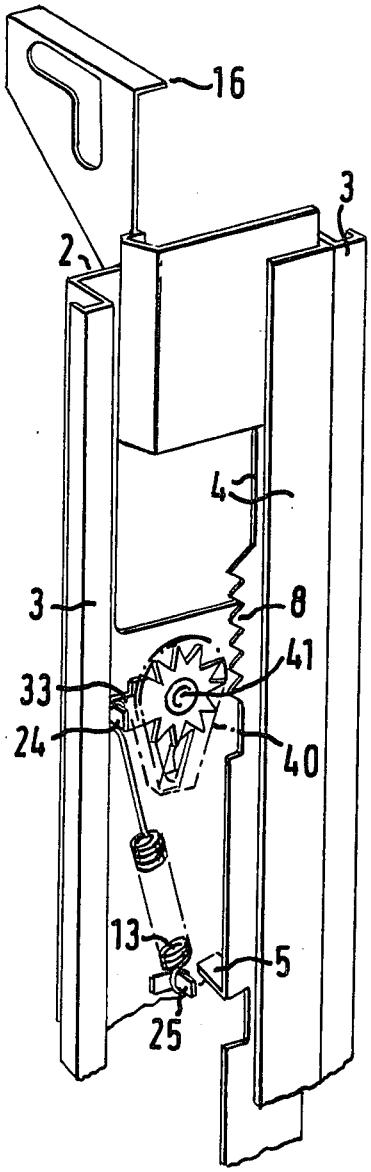
FIG. 1 is a perspective view of part of a drawer autolock mechanism.
Figure 1B:
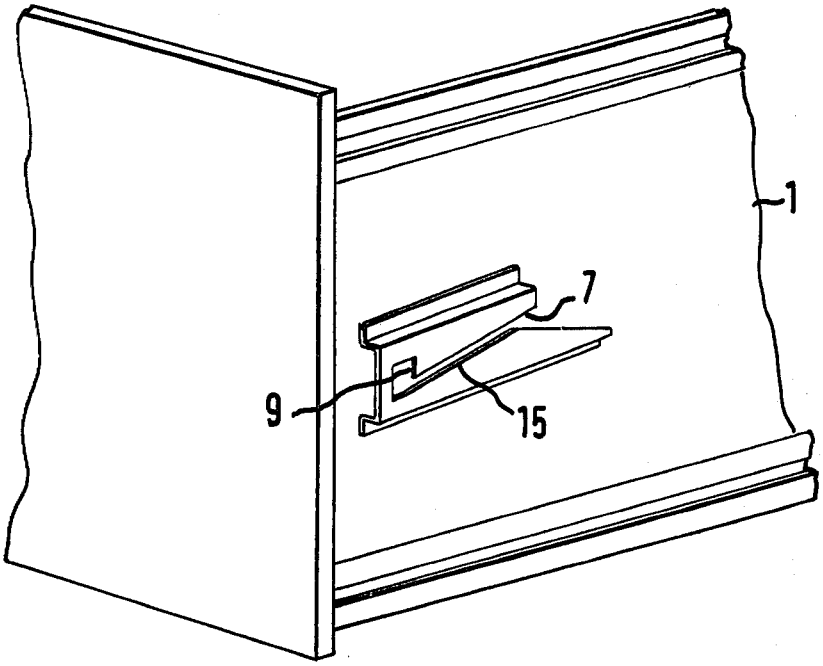
FIG. 1B is a perspective view of part of a cabinet drawer.
Figure 6:
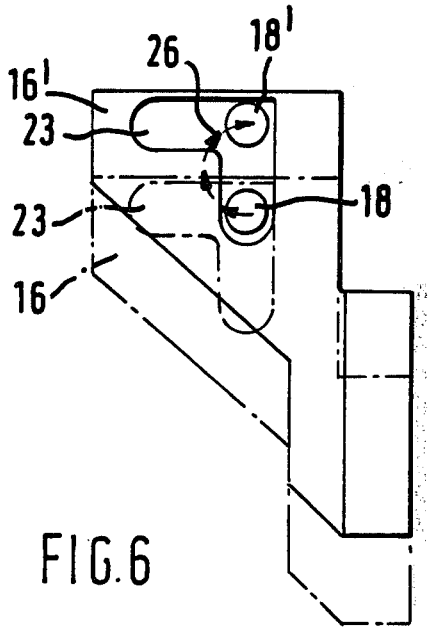
FIG. 6 illustrates different working positions of the details shown in FIG. 1A.
Figure 3:
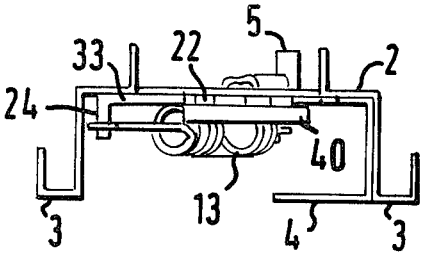
FIGS. 2 and 3 are respectively a front elevation and plan of part of the mechanism shown in FIG. 1.

Referring to FIGS. 1, 1A and 6 a key-lock mechanism comprises a flag 16 welded to the top end of the locking bar 4, this flag being formed from a length of strip metal bent to the required shape. A roller 18 eccentrically mounted relative to a barrel 19 of a key-operated lock 20, on an arm 21, cooperates with the flag as will be explained in detail hereinbelow with reference to FIG. 6.

Operation of the autolock mechanism will now be described in detail with particular reference to FIGS. 4 and 5. In FIG. 4, both drawers 1 of the filing cabinet are closed. It will be seen that the actuating tags 5 are positioned at the entrances to their cam tracks 7. As the top drawer is opened, relative movement between its inclined cam track 7 and actuating tag 5 causes the locking bar 4 to slide vertically in the channel member, thereby bringing the actuating tag 5 associated with the lower drawer into the position shown in FIG. 5 where it is opposite a shoulder 9 at the entrance to the cam track. The spring 13 holds the locking bar 4 in its raised position even when the upper drawer 1 is opened fully and the actuating tag 5 is no longer urged upwardly by the cam track 7. It will be noted that any attempt to open the bottom drawer of the filing cabinet will fail because the shoulder 9 abuts with the actuating tag 5 associated with the lower drawer. Thus, while the drawer 1 is open, the lower drawer is locked shut.

When the upper drawer 1 is pushed back towards its closed position, the cam track 7 comes into engagement with the actuating tag 5, a lower boundary 15 of the cam track ensuring that even if the locking bar should drop at all whilst the drawer is fully open, the necessary engagement between the cam track and actuating tag can be guaranteed as the drawer is shut. Owing to the engagement the cam track forcibly displaces the locking bar 4 downwardly and in so doing causes the tension in spring 13 to increase and to pass eventually through its centre state and finally return to the position shown in FIG. 4. Then the bottom drawer can be opened, if desired, since the actuating tag 5 associated with it is no longer opposite the shoulder 9 but is in fact aligned with the entrance to its cam track 7. Clearly, the autolock mechanism functions in an analogous way, when the bottom drawer is opened, to lock the top drawer shut.

The key-lock mechanism will now be described with reference to FIGS. 1 and 6. The roller 18 is shown in its unlocked position in FIG. 1A. With all the drawers shut as shown by a broken line in FIG. 6, the roller 18 is positioned at the entrance to a channel 23 formed in the flag. If one of the drawers is opened, the resulting vertical displacement of the locking bar causes the flag 16 to move into the position 16' indicated in full lines, while the roller 18 remains stationary. On closing the drawer, the flag 16 returns to its original position with the roller at the entrance to the channel 23.

When (with all the drawers shut) a key is inserted into the lock 20 and turned, the arm 21 rotates through a half revolution clockwise so that the roller 18 follows the arcuate path 26 to arrive at the position 18'. It will be appreciated from FIG. 6 that as the roller 18 moves along the path 26 it initially enters the channel 23, then it moves right to the bottom of the channel and then returns to a position 18' at the entrance to the channel 23. During this time, the flag has been raised by the roller 18 from the position indicated in broken lines to the position 16'. Thus, all the actuating tags on the locking bar are positioned opposite their respective shoulders 9 alongside the entrances to the cam tracks 7 and so none of the drawers can be opened. To unlock the cabinet, it is merely necessary to rotate the arm 21 through a half-revolution in the anti-clockwise sense to lower the locking bar and thereby release the drawers.

Of course, although the description of FIGS. 4 and 5 herein relate to a two-drawer cabinet, the autolock mechanism can be adapted to a filing cabinet with many more drawers (e.g., four as shown in FIG. 9) merely by providing additional actuating tags on the locking bar and cam tracks on the additional drawers. Then, opening of any one drawer will cause all the others to be locked shut.

In addition to the described autolock mechanism having a positive over-centre locking action, it is simple and cheap to produce in mass production, in particular because the pinion and its arm, and also the locking bar formed with its teeth, can be made in a sheet metal stamping process. In the case of the locking bar, the stamping process is followed by an appropriate bending operation.

It will be appreciated that when, for example, the cabinet is being carried up or down stairs in a position in which it is turned from the upright position to a position in which the locking bar 4, in the absence of some restraining device, can slide under its own weight or inertia towards what is normally the top end of the cabinet, all the drawers will be locked shut by this movement, it being assumed that the drawers have not previously been locked by the lock 20. Then when the cabinet is returned to the upright position, the drawers will remain locked and cannot be unlocked by the lock 20 because this will be held in the unlocked position by the locking bar 4 in its raised position.

Figure 7:
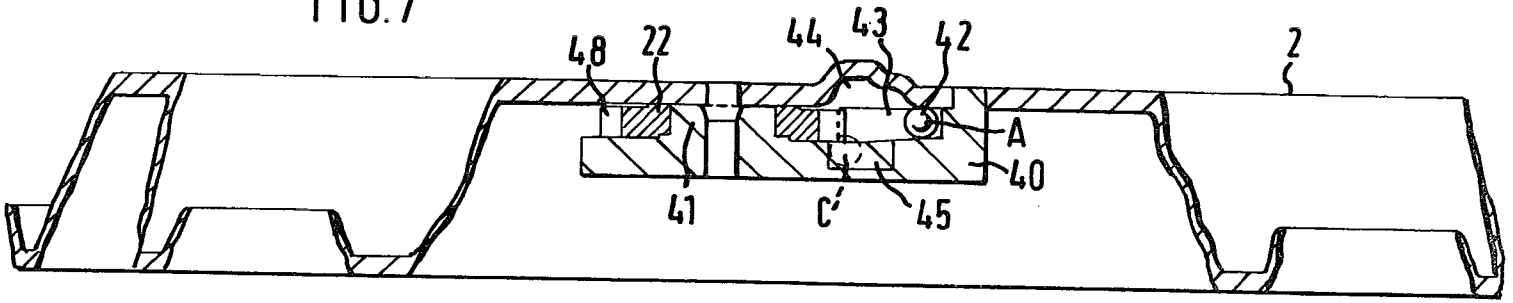
FIGS. 7 and 8 respectively show different operative conditions of a portion of the mechanism shown in FIG. 1.
Figure 8:
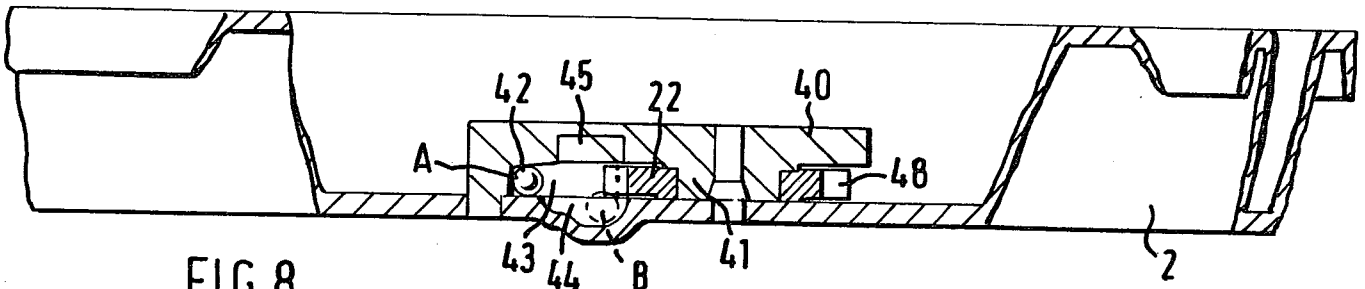

A gravity actuated device is, therefore, mounted adjacent the pinion 22 for holding the locking bar down in such conditions. This gravity actuated device comprises a plastics member 40 fixed to the channel member 2 and formed with a bush 41 for the pinion 22. When the channel member 2 is upright a metal ball 42 lies at the bottom of a recess 43 in the member 40, the ball then being in the position A in FIGS. 7 and 8. The recess 43 lies between a depression 44 formed in the channel member and a depression 45 in the member 40. Depending on whether the channel member 2 happens to be at the top of the tilted cabinet (FIG. 7) or at the bottom of the tilted cabinet (FIG. 8), when the cabinet is turned over to the horizontal or nearly horizontal position, the ball 42 will run along one or other of the sides 46, 47 (FIG. 1C) of the recess 43 into one of the depressions 44, 45 to take up the position B or C. When in a depression 44 or 45, the ball locks the pinion against rotation because the ball projects slightly out of the depression to engage a pinion tooth 48 so that the ball is held between the tooth and one side of the depression. The locking bar 4 is, therefore, held against longitudinal movement so that the actuating tags 5 cannot engage the shoulders 9.

The inclination of the sides 46, 47 of the recess 43 is such that the ball 42 reaches its locking position before the locking bar 4 reaches the horizontal position.

I claim:

1. A storage cabinet assembly comprising a cabinet having side walls, a rear wall and a front frame formed with openings therein for the passage of at least two sliding drawers arranged one above the other to slide through said openings from shut positions within said cabinet to projecting open positions, at least two drawers mounted in said cabinet to slide between said shut and open positions, each said drawer having side walls and a front wall, vertical guide means fixed inside one side wall of said cabinet and extending over the adjacent side walls of said drawers, an upright locking bar displaceable in said guide means longitudinally of itself between upper and lower positions, one of which is a drawer-locking position and the other a drawer-releasing position, locking means on said locking bar and means on said adjacent side walls of said drawers cooperating with said locking means to lock each drawer only when in its shut position and when said locking bar is in its drawer-locking position, locking bar actuating means on each drawer for displacing said locking bar from its drawer-releasing position to its drawer-locking position during the initial part of the opening of the drawer to lock each remaining drawer shut, a spring having one end fixed with respect to said cabinet, means operatively connecting the other end of said spring to said locking bar whereby when said locking bar is moved from the drawer-releasing position to the drawer-locking position said spring passes through an over-centre position from a first state in which it ends to hold the locking bar in the drawer-releasing position to a second state in which is retains the locking bar in the drawer locking position, said means operatively connecting said other end of said spring to said locking bar comprising a mechanism which includes a lever arm, said other end of said spring being fixed to said lever arm at a point which undergoes augmented movement relatively to the movement of said locking bar during the displacement of said locking bar, said locking bar including a line of gear teeth thereon, said locking mechanism including a pinion pivoted about an axis fixed with respect to said cabinet and having its teeth engaged with said teeth on said locking bar, said lever arm being fixed to said pinion and the radius at which said point is located with respect to said axis being greater than the radius of said pinion, and further cooperating means on each said side wall of said drawers for returning said locking bar to its drawer-releasing position and said spring to its first state when a drawer is returned from its open position to its shut position.

2. A storage cabinet assembly according to claim 1, in which said point is arranged, when said locking bar is moved from the drawer-releasing position, to undergo a comparatively small movement during which said spring is increasingly stressed until said point reaches the over-centre position and then relaxes until it reaches said second state, in which second state said spring is still under some stress and acts by way of a substantial turning moment on said lever to retain said locking bar in the drawer-locking position.

3. A storage cabinet assembly according to claim 1, in which said locking means on said locking bar comprise projections respectively associated with said drawers, and said cooperating means and said further cooperating means on each drawer respectively comprise a drawer-locking cam track with an associated shoulder and a drawer-releasing cam track, each said projection being arranged to be engaged by the associated drawer-locking cam track only during the initial part of the opening of the drawer, but long enough for the locking bar to be moved to its drawer-locking position wherein each shut drawer is locked by the associated locking bar projection engaging the shoulder on the drawer, said drawer-releasing cam track being arranged, when the drawer on which it is provided is being closed, to engage the associated locking bar projection and move said locking bar to its drawer-releasing position.

4. A storage cabinet assembly according to claim 1, in which said upper and lower positions of said locking bar are respectively said drawer-locking and drawer-releasing positions.

5. A storage cabinet assembly according to claim 1, comprising a key-lock mechanism mounted on said cabinet to be operatively coupled to said locking bar and provided with a locking bar actuating member positioned in an ineffective position when said key-lock mechanism is unlocked and movable to an effective position by locking said key-lock mechanism, and a coupling member fixed on said locking bar to be engaged by said coupling member to move said locking bar to its drawer-locking position when said actuating member is being moved to its effective position, thereby locking all said drawers shut.

6. A storage cabinet assembly according to claim 5, comprising a gravity responsive device operative on said locking bar to inhibit longitudinal movement thereof if said cabinet is tilted in such a way as to cause said locking bar to tend to travel to its drawer locking position, said gravity responsive device thereby preventing all said drawers from becoming locked by longitudinal movement of said locking bar.

7. A storage cabinet assembly according to claim 1, in which said locking bar is formed with a line of gear teeth and said mechanism comprises a pinion pivoted about an axis fixed with respect to said cabinet and having its teeth engaged with said teeth on said locking bar, said lever arm being fixed to said pinion, and said cabinet assembly further including means fixed with respect to said cabinet defining a track for a ball, and a ball free to run under gravity along said track, said track being located for said ball to run between an idle position and a position in which said ball engages between said fixed means and a tooth on said pinion to hold said locking bar against movement when said cabinet is moved from its upright position to a horizontal position, thereby preventing all said drawers from becoming locked by such cabinet movement.

8. A storage cabinet assembly according to claim 1, in which further includes means fixed with respect to said cabinet defining a track for a ball, and a ball free to run under gravity along said track, said track being located for said ball to run between an idle position and a position in which said ball engages between said fixed means and a tooth on said pinion to hold said locking bar against movement when said cabinet is moved from its upright position to a horizontal position, thereby preventing all said drawers from becoming locked by such cabinet movement and said fixed means bieng formed also with ball-receiving depressions communicating with said track and respectively located on opposite faces of said pinion, whereby one of said depressions receives said ball when said cabinet is tilted with said locking bar at the top of said cabinet and the other of said depressions receives said ball when said cabinet is tilted with said locking bar at the bottom of said cabinet, and from either of which depressions said ball will project into engagement with a pinion tooth to hold said locking bar against movement.

* * * * *